United States Patent [19]

Trudel

[11] Patent Number: 4,906,128

[45] Date of Patent: Mar. 6, 1990

[54] ADJUSTABLE MANHOLE COVER

[76] Inventor: Roger Trudel, 218 John St., Sudbury, Ontario, Canada, P3E 1P6

[21] Appl. No.: 261,453

[22] Filed: Oct. 24, 1988

[30] Foreign Application Priority Data

Apr. 12, 1988 [CA] Canada ..... 563959-0

[51] Int. Cl.[4] ..... E02D 29/14

[52] U.S. Cl. ..... 404/26; 404/25; 52/20

[58] Field of Search ..... 404/25, 26; 52/19–21; 49/463, 465

[56] References Cited

U.S. PATENT DOCUMENTS

| | | | |
|---|---|---|---|
| 3,218,943 | 11/1965 | Bowman | 404/26 |
| 3,263,580 | 1/1966 | MacMillan | 404/25 |
| 4,075,796 | 2/1978 | Cuozzo | 404/26 |
| 4,255,909 | 3/1981 | Soderstrom | 404/26 |
| 4,281,944 | 8/1981 | Bowman | 404/26 |
| 4,512,492 | 4/1985 | Graybeal | 404/25 |
| 4,608,787 | 9/1986 | Carlson | 404/25 |

FOREIGN PATENT DOCUMENTS

| | | | |
|---|---|---|---|
| 1538172 | 7/1968 | France | 404/26 |
| 6413948 | 6/1966 | Netherlands | 52/20 |
| 8402712 | 4/1986 | Netherlands | 52/21 |
| 527582 | 10/1940 | United Kingdom | 52/20 |

*Primary Examiner*—Jerome W. Massie
*Assistant Examiner*—Gay Ann Spahn
*Attorney, Agent, or Firm*—Burke-Robertson

[57] ABSTRACT

An adjustable manhole top which can be readily raised up or down in minutes to correct problems when the ground around it heaves. A cylindrical sleeve with a plurality of spaced elongated shoulders extending longitudinally along an internal surface thereof, is adjustably seated about upwardly extending projections from a support rim. A lock, removably supported on the support rim, is provided with a height adjustment mechanism to support a corresponding shoulder on the sleeve, to secure the sleeve at a desired height.

16 Claims, 2 Drawing Sheets

ADJUSTABLE MANHOLE COVER

BACKGROUND OF THE INVENTION

The present invention relates to an adjustable manhole top, and more particularly to a manhole top which can be raised up or down to correct problems caused when ground around the manhole heaves.

The ground about a manhole may heave, for example during winter conditions of consecutive frosts and thaws. This may make it very difficult for example for snowplows, the blades of which may then catch an upwardly projecting edge of the manhole cover or manhole cover support.

Conventional manholes have a foundation, of circular cross sectional shape, which may be of poured concrete. Above this foundation, and supported thereon, are bricks which in turn support a manhole cover plate having a manhole cover supporting rim. Asphalt or cement for the roadway is generally laid on or about the manhole cover plate. When the ground level about a manhole changes for whatever reason, for example from frost heaves or erosion of the ground about the manhole, repair work so that the manhole cover is again level with the surface of the roadway may require significant labour, including ripping up of the roadway surface and removal of the manhole cover plate and bricks, down to the concrete foundation. Thus, there is a need for a manhole top which can be easily adjusted, in a vertical direction, to take into account periodic changes in the level of the surrounding roadway.

Adjustable manhole tops are known. For example Canadian Patent No. 1,081,020 describes and illustrates a construction of manhole top in which screw bolts are passed through the manhole cover to bear against a support for raising or lowering the cover. Canadian Patent No. 1,161,263 describes and illustrates slip rings which go under the cover and its support to permit it being incrementally raised. Canadian Patent No. 68,905 describes and illustrates a construction in which the bottom of the manhole cover is provided with saw teeth on an incline to interact with corresponding saw teeth on an incline on a base support, to permit, upon relative rotation of the cover and base, the raising or lowering of the cover. Canadian Patent No. 1,068,961 features screw bolts which extend upwardly from the base to bear against the underside of the manhole cover to permit its raising or lowering. Such constructions possess many inherent difficulties, such as that of corrosion and seizing of the adjustment mechanisms or the need to rip up the roadway about the manhole top to activate the adjustment mechanism.

U.S. Pat. No. 2,254,668 of Tomek issued Sept. 2, 1941 describes and illustrates an upwardly and downwardly adjustable sleeve on which the manhole cover is supported. The sleeve telescopically fits on a cylindrical support base. The adjustable sleeve is levelled, to provide a proper manhole cover level, embedding a flange or the like which outwardly extends from the outer surface of the sleeve in the roadway surface while the sleeve is supported at a proper height. Again, this proposed construction faces many of the same problems of conventional manhole tops. The heaving of the roadway, for example, will result in breaking of the roadway about the manhole sleeve as a result of the flange embedded therein. This will require additional resurfacing of the roadway about the manhole sleeve. As well, the sleeve over time will tend to corrode and become seized in position on the cylindrical suPPort base, making it extremely difficult to adjust.

Thus, it is an object of the present invention to provide a vertically adjustable manhole top which is designed to be easily vertically adjustable, with minimum need for excavation or resurfacing prior to, during or after adjustment. It is a further object of the present invention to provide such an adjustable manhole top which allows the passage of water, sand and the like through it, into the manhole, without clogging up the top. It is a further object of the present invention to provide such an adjustable manhole top in which corrosion does not significantly impede the adjustment operation.

SUMMARY OF THE INVENTION

In accordance with the present invention there is provided an adjustable manhole top comprising a cylindrical sleeve having an internal, manhole cover-supporting rim towards one end. A plurality of spaced elongated shoulders extend longitudinally along an internal surface of the sleeve. The top also has a support rim comprising a planar base to be rested on the upPer edge of a manhole foundation. A portion of the base extends inwardly beyond the inner wall of the sleeve when in position to supportably receive the cylindrical sleeve. A portion of the rim extends upwardly from the base and is positioned so as to receive the cylindrical sleeve. A plurality of lock means are provided, positionable to be movably supported on the base. An individual lock means is provided for each of the elongated shoulders of the sleeve, the lock means being constructed so as to support the shoulders and prevent relative rotative or vertical movement of the cylindrical sleeve with respect to the support rim when the lock means are in position on the rim base.

In a preferred embodiment, confronting surfaces of co-operating lock means and elongated shoulders are provided with mating, height adjustment means whereby the cylindrical sleeve is supported at a predetermined height above the base of the support rim when the lock means are in position supported on the support rim base with the height adjustment means thereof being mateably received in the corresponding height adjustment means of the corresponding elongated shoulders.

In another preferred embodiment, each of the lock means is provided with a pluralitY of horizontal surfaces, upwardly stePped from a base of the lock means, the lock means base to be supported upon the rim support base in position so that a bottom surface of the corresponding elongated shoulder of the cylindrical sleeve rests thereon to support the cylindrical sleeve a predetermined height above the base of the support rim.

The manhole top according to the present invention can be elevated or depressed, so that the manhole cover remains flush with the surface of the roadway, simply and in little time. Excavation of the roadbed around the manhole top would not normally be required to carry out such adjustment. Moreover, because of the construction of the manhole top in accordance with the Present invention, corrosive seizing of the relatively movable parts of the manhole top in accordance with the present invention is minimized.

BRIEF DESCRIPTION OF THE DRAWINGS

These and other objects and advantages of the invention will become apparent upon reading the following detailed description and uPon referring to the drawings in which.

Figure 1:
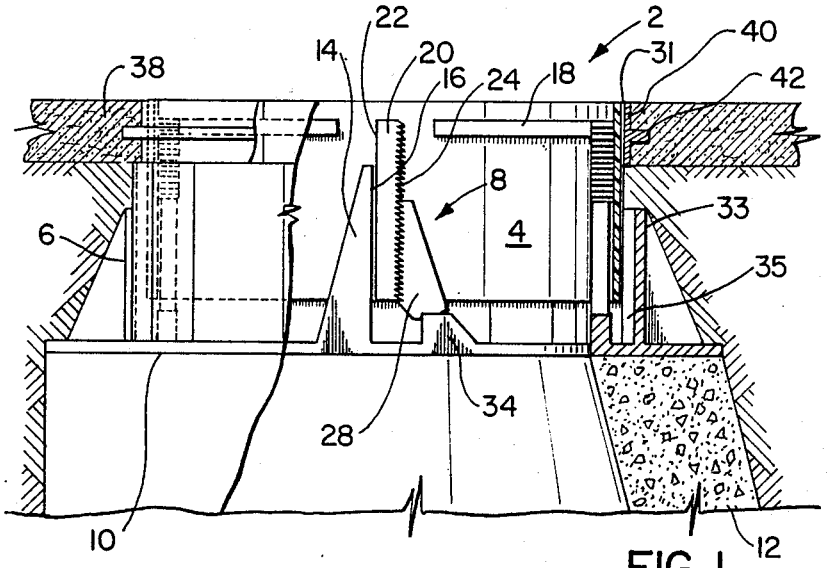
FIG. 1 is a side elevation, partly broken away, of a manhole top in accordance with the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 2:
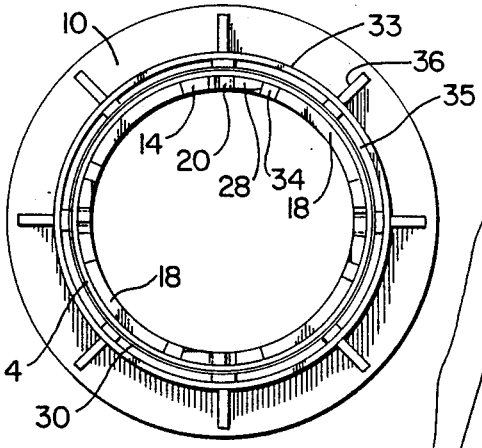
FIG. 2 is a plan view from above of the manhole top of FIG. 1.

Turning to FIGS. 1 and 2 there is illustrated an adjustable manhole top 2 in accordance with the present invention, comprising a vertically adjustable cylindrical sleeve 4, a support rim 6 and an adjustment lock means 8. Support rim 6 has an annular base 10 which is seated on the upper edge of the poured concrete foundation 12 of the manhole. A plurality of spaced, upwardly extending projections 14 from base 10 are provided about support rim 6 as illustrated, these upwardly extending projections having, in one direction, a flat, radially extending surface 16. Projections 14 are positioned so that sleeve 4 circumscribes these projections as illustrated.

Figure 3:
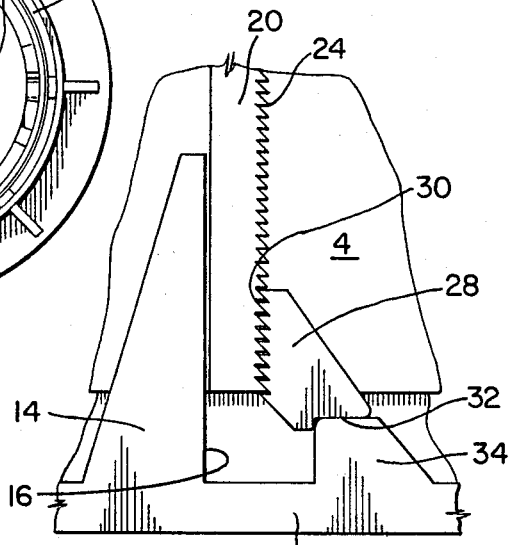
FIG. 3 is a detail view of the height adjustment lock mechanism of the manhole top of FIG. 1.

On the interior surface of sleeve 4 is positioned, near its top, a manhole cover supporting rim 18. A plurality of spaced, elongated shoulders 20 extend longitudinally, in a direction parallel to the axis of the cylindrical sleeve, along that surface. These elongated shoulders 20 are preferably equally spaced. Each has a flat, radially extending surface 22 positioned to abut against surface 16 of a corresponding projection 14 when the cylinder 4 is in position. The other side of shoulder 20 is provided with a plurality of outwardly and laterally extending teeth 24. For each of the shoulders 20 is a corresponding height adjustment lock means 8 in the form of a dog 28. Each dog 28 has mating teeth 30, along one edge thereof as illustrated, so that when it is in seated position, its teeth 30 mateably engage teeth 24 of a corresponding shoulder 20. A notch 32 is formed in the base of dog 28 as illustrated, which notch provides seated engagement of dog 28 on the top of a corresponding upstanding rib 34. Upstanding rib 34 is spaced on base 10 an appropriate distance from surface 16 of projection 14 as will be described in more detail hereinafter. The teeth 30 of dogs 28, as well as teeth 24 of shoulders 20 are formed, as illustrated in FIG. 3, so that one of the two surfaces of the teeth is parallel to the plane of base 10. In this manner, when dog 28 is seated on rib 34 as illustrated, with teeth 30 and 24 in engagement and sleeve 4 being positioned vertically, with respect to base 10 of rim 6, at an appropriate relative height, downward pressure on sleeve 4 will be transmitted downwardly in a direction normal to that of the plane of base 10. In this manner there will be no tendency for a rotative motion of sleeve 4 with respect to rim 6 when such downward pressure is apPlied to rim 4, and dog 28 will remain in seated engagement on rib 34, holding shoulder 20 with its surface 22 abutting against surface 16 of extension 14 as illustrated. The shaping of teeth 24 and 30 is such that, in conjunction with the notch 32 in the bottom of dog 28, dog 28 will remain rigidly in Position as downward pressure is applied to the top of sleeve 4.

In practice, it is preferred that the orientation of teeth 24 on shoulders 20 be reversed, as illustrated in FIG. 1, for example from one shoulder 20 to the next about inner surface of sleeve 4. In other words, laterally extending teeth 24 are placed on different sides of shoulder 20, from one shoulder to the next. In such instances, the arrangement of projections 14, dogs 28 and ribs 34 must also be reversed to accommodate the reversal of the position of teeth 24. In this way, by ensuring opposite orientation of the teeth 24 on at least some of shoulders 20, relative rotative forces which might be exerted on, and tend to turn, sleeve 4, for example by a snowplow blade striking a protruding edge of sleeve 4 in a tangential direction, will be restricted.

On the other hand, to change the relative elevation of sleeve 4, and hence a manhole cover seated on rim 18, a worker need only remove dogs 28 from their seated position as illustrated in FIG. 3, by reducing the downward pressure on sleeve 4, and re-engaging shoulder 20 and dog 28 teeth 24 and 30 while sleeve 4 is at the appropriate relative height with respect to the base of rim 6. Dog 28 will then again be in position as illustrated in FIG. 3. This adjustment requires no digging up of the road surface and plate and bricks above the manhole foundation, as with prior art devices. As well, because of the construction of rim 6, sleeve 4 comes in contact with rim 6 only over limited areas, i.e. on the outside surfaces of projections 14, making it easier to lift sleeve 4 and more difficult for sleeve 4 to become corroded or seized in position with respect to support rim 6. To further facilitate the adjustment of the relative height of sleeve 4 with respect to the base of rim 6, the outer surface of sleeve 4 may be covered with a coating or sleeve 31 of non-corrosive material such as a plastic. This will also reduce the chance of the roadway pavement or asphalt sticking to sleeve 4 as its elevation is adjusted.

Spaced from upwardly extending projections 14, and upwardly extending from the base 10 of support rim 6 is a cylindrical wall 33, the space 35 between wall 33 and upward extensions 14 and webs 34 receiving the lower edge of sleeve 4. This space 35 and the construction of support rim 6 with spaced upward extensions 14 and webs 34 allow water, sand and other debris to pass through the sides of the manhole top and into the manhole, without clogging the device. Support ribs 36 radially extend from base 10 to wall 33 to provide additional support.

In a preferred form of the invention, a retainer collar 40 is snugly fitted about the upper end of sleeve 4, so that the upper edge of sleeve 4 and the upPer edge of collar 40 are approximately flush. When cement is Poured or asphalt is laid about a manhole incorporating a top 2 including such a collar 40, outer annular projection 42 of collar 40 becomes embedded in the cement or asphalt, to secure the collar in position. If the roadway surface subsequently lifts or heaves, for example as a result of frost, the collar will lift with it and the edge of the cement or asphalt surface about the collar will not break or deteriorate as traffic runs over the edge of that surface and collar.

Figure 4:
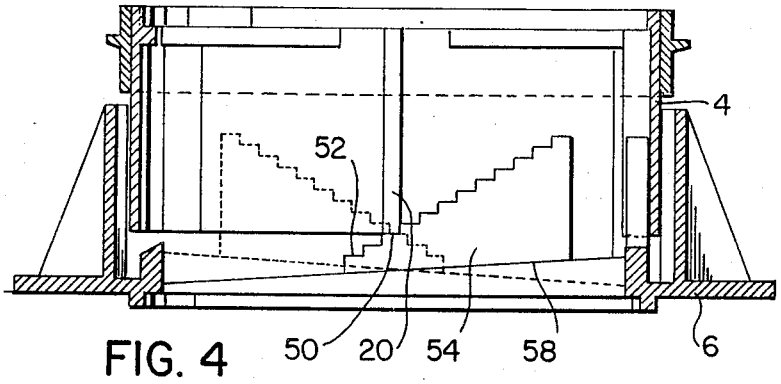
FIG. 4 is a side elevation, broken away, of a manhole top of an alternative, Preferred embodiment of a manhole top in accordance with the present invention.
Figure 5:
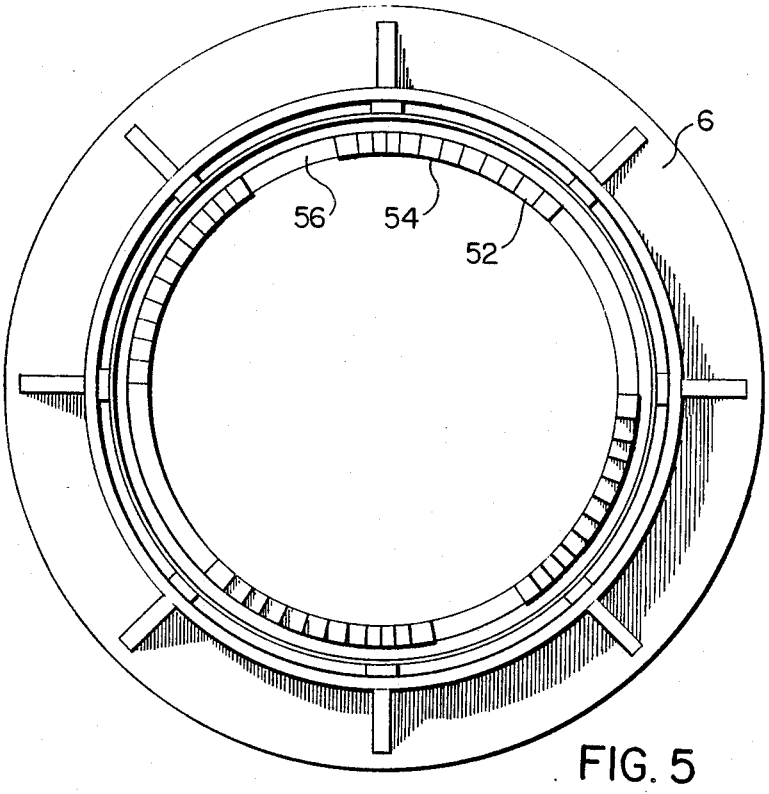
FIG. 5 is a plan view from above of the manhole top of FIG. 4.

Turning to FIG. 4, there is illustrated a further, preferred embodiment of the manhole top in accordance with the present invention. In this embodiment, the interior surface of sleeve 4 is similarly provided with a plurality of spaced, elongated shoulders 20 extended longitudinally in a direction parallel to the axis of the cylindrical sleeve, along that surface. Instead of laterally extending teeth 24 interlocking with a dog 28, as in the embodiment of FIGS. 1 to 3, to enable a desired relative height of sleeve 4 to be achieved with respect to rim 6 and its base 10, the lower surface 50 of each shoulder 20 rests on a predetermined horizontal surface 52 of an associated height adjustment block 54. Each height adjustment block 54 is provided, as illustrated, with a plurality of such horizontal surfaces 52 arranged in upwardly stepped fashion as illustrated. Each of the adjustment blocks 4 is curved and supported on an annular rim portion 56 of base 10 of support rim 6 which extends inwardly beyond the inner wall of sleeve 4 when in position on base 10 (FIG. 5). It will be noted (FIG. 4) that this annular portion of base 10 is upwardly sloped to the right in the vicinity of the corresponding shoulder 20, and that the base 58 of adjustment block 54 is correspondingly angled so as to ensure that the upper stepped surfaces 52 remain horizontal. A corresponding surface of at least one other portion of the annular rim of base 10, in the vicinity of another shoulder 20 will be similarly sloped but in the opposite direction (shown schematically in phantom, FIG. 4). In this way forces exerted on the manhole top tending to dislodge adjustment blocks 54 will be neutralized.

In operation, as illustrated in FIG. 1, pavement 38 is laid flush with the outer edge of collar 40, when sleeve 4 has been positioned, with respect to base 10 of support rim 6, at an appropriate elevation, and collar 40 has been fitted about the upper end of sleeve 4.

As previously indicated, the manhole top of the present invention can be raised up or down in minutes to correct problems caused when the ground around it shifts, for example as a result of heaving or erosion. It would be understood that the conventional brick work needed to support the manhole support plate is not required, thereby providing a more secure and long lasting construction.

Thus it is apparent that there has been provided in accordance with the invention an adjustable manhole top that fully satisfies the objects, aims and advantages set forth above. While the invention has been described in conjunction with a specific embodiment thereof, it is evident that many alternatives, modifications and variations will be apparent to those skilled in the art in light of the foregoing description. For example, a similar construction, but in square or rectangular transverse cross-sectional shape, would be used for roadway catch basins. Accordingly, it is intended to embrace all such alternatives, modifications and variations as fall within the spirit and broad scope of the invention.

What I claim as my invention:

1. An adjustable manhole top comprising;

(a) a cylindrical sleeve having an internal, manhole cover-supporting rim towards one end, a plurality of spaced, elongated shoulders extending longitudinally along an internal surface of the sleeve;

(b) a support rim comprising a planar base to be rested on the upper edge of a manhole foundation a portion of the base extending inwardly beyond the inner wall of the sleeve when in position to supportably receive the cylindrical sleeve, a portion of the rim upwardly extending from said base and positioned so as to receive the cylindrical sleeve; and (c) a plurality of lock means positionable to be movably supported on the base, an individual lock means being provided for each of the elongated shoulders of the support sleeve, said lock means constructed so as to support the shoulders and prevent relative rotative or vertical movement of the cylindrical sleeve with respect to the support rim when the lock means are in position on the rim base.

2. An adjustable manhole top according to claim 1 wherein confronting surfaces of co-operating lock means and the sides of the elongated shoulders are provided with mating, height adjustment means whereby the cylindrical sleeve is supported at a predetermined height above the base of the support rim when the lock means are in position supported on the support rim base with the height adjustment means thereof being mateably received in the corresponding height adjustment means of the corresponding elongated shoulders.

3. An adjustable manhole top according to claim 2 wherein confronting surfaces of the lock means and the elongated shoulders are provided with a plurality of mating teeth to permit securing the sleeve at different relative heights above the support rim base.

4. Adjustable manhole top according to claim 3 wherein each of the teeth have two flat surfaces extending radially across the surface of the side of the shoulder or confronting surface of the lock means.

5. An adjustable manhole top according to claim 4 wherein one of the surfaces of each of the teeth is in a plane parallel to the plane of the base of the support rim whereby, when the teeth of the lock means are engaged in the teeth of the elongated shoulders of the sleeve, the support rim receives forces exerted on the cylindrical sleeve and lock means in a direction normal to its plane.

6. An adjustable manhole top according to claim 2, wherein the base of the support rim is annular and is provided with a plurality of upstanding ribs spaced circumferentially from the shoulder-receiving surface of the upwardly extending projections, the base of the lock means being notched to be seatably received on the top of a corresponding rib so that, when in position with the height adjustment means of the elongated shoulders and lock means mateably engaged, the lock means is firmly seated and secured against unintentional disengagement.

7. An adjustable manhole top according to claim 1 wherein the upstanding wall of the support rim is cylindrical and the rim is provided with a plurality of spaced, radially extending webs upwardly projecting from the base to support the upstanding wall of the support rim.

8. An adjustable manhole top according to claim 2, wherein the base of the support rim is annular and is provided with a plurality of upstanding ribs spaced circumferentially from the shoulder-receiving surface of the upwardly extending projections, the base of each of the lock means being notched to be seatably received on the top of a corresponding rib so that, when in position with the height adjustment means of the elongated shoulders and lock means mateably engaged, each lock means is firmly seated on the corresponding rib and secured against unintentional disengagement; the upstanding wall of the support rim being cylindrical and the rim being provided with a plurality of spaced, radially extending webs upwardly projecting from the base to support the upstanding wall of the support rim.

9. An adjustable manhole top according to claim 1 wherein the cylindrical sleeve is provided with an outer, non-corrosive liner to reduce corrosion and facilitate adjustment of the sleeve with respect to pavement which has been laid flush with the sleeve.

10. An adjustable manhole top according to claim 1 wherein the elongated shoulders of the cylindrical sleeve are equally spaced about the internal surface of the sleeve.

11. An adjustable manhole top according to claim 2 wherein the mating height adjustment means are placed on an opposite side of one or more of the elongated shoulders so as to cooperate with appropriately placed confronting surfaces of cooperating lock means so that relative rotative forces exerted on and intending to turn the sleeve are resisted.

12. An adjustable manhole top according to claim 1 further provided with an annular retainer collar adapted to be snugly fitted about the upper end of the sleeve so that the upper edge of the sleeve and the upper edge of the collar are approximately flush, the retainer collar having an outwardly extending annular projection from its exterior surface, this projection to become embedded in a poured roadway surface about the manhole top, the roadway surface to be laid to the upper edge of the retainer collar.

13. An adjustable manhole top comprising:

(a) a sleeve having an internal, manhole cover-supporting rim towards one end, a plurality of spaced, elongated shoulders extending longitudinally along an internal surface of the sleeve;

(b) a support rim comprising a planar base to be rested on the upper edge of a manhole foundation, a portion of the base extending inwardly beyond the inner wall of the sleeve when in position to supportably receive the cylindrical sleeve, a portion of the rim upwardly extending from said base and positioned so as to receive the sleeve; and (c) a plurality of lock means positionable to be movably supported on the base, an individual lock means being provided for each of the elongated shoulders of the support sleeve, said lock means constructed so as to support a corresponding shoulder and prevent relative rotative or vertical movement of the sleeve with respect to the support rim when the lock means are in position on the rim base.

14. An adjustable manhole top according to claim 13 further comprising a retainer collar adapted to be snugly fitted about the upper end of the sleeve so that the upper edge of the sleeve and the upper edge of the collar are approximately flush, the retainer collar having an outwardly extending projection from its exterior surface, this projection to become embedded in a poured roadway surface about the manhole top, the roadway surface to be laid to the upper edge of the retainer collar.

15. An adjustable manhole top according to claim 1 wherein each of the lock means is provided with a plurality of horizontal surfaces upwardly stepped from a base of the lock means, the lock means base to be supported on the support rim base in position so that a bottom surface of the corresponding elongated shoulder of the cylindrical sleeve rests thereon to support the sleeve a predetermined height above the base of the support rim.

16. An adjustable manhole top according to claim 15 wherein the base of the support rim under each of the lock means is gently sloped with respect to horizontal, the slope being in an opposite direction under at least one of the lock means.

* * * * *